US006415744B1

(12) United States Patent
Choi

(10) Patent No.: US 6,415,744 B1
(45) Date of Patent: Jul. 9, 2002

(54) COMBUSTION BOILER

(75) Inventor: Jin-min Choi, Seoul (KR)

(73) Assignee: Kiturami Gas Boiler Co., Ltd., Inchon (KR)

( * ) Notice: Subject to any disclaimer, the term of this patent is extended or adjusted under 35 U.S.C. 154(b) by 0 days.

(21) Appl. No.: 09/873,274

(22) Filed: Jun. 5, 2001

(51) Int. Cl.[7] ..... F22B 7/04
(52) U.S. Cl. ..... 122/18.1; 122/15.1; 122/19.1
(58) Field of Search ..... 122/15.1, 18.1, 122/19.1, 30, 135.1, 136 C, 409; 415/199.4; 416/198 R

(56) References Cited

U.S. PATENT DOCUMENTS 5,579,756 A * 12/1996 Jonsson ..... 122/136 R

* cited by examiner

*Primary Examiner*—Gregory A. Wilson
(74) *Attorney, Agent, or Firm*—Birch, Stewart, Kolasch & Birch, LLP

(57) ABSTRACT

The present device relates to a combustion boiler having a fan part provided with a driving motor, a suction fan secured on a rotary shaft of the driving motor and disposed on a suction line, for forcedly sucking air in the room or from the outside, and an exhaust fan secured on the rotary shaft of the driving motor and disposed on an exhaust line, for forcedly exhausting an exhaust gas to the outside. Hence, the air in the room or from the outside is forcedly sucked to the suction line by means of the suction fan and the exhaust gas is forcedly exhausted to the exhaust line by means of the exhaust fan. In this way, the flowing of air is constantly kept in all of the suction, combustion and exhaust lines.

2 Claims, 13 Drawing Sheets

-PRIOR ART-

-PRIOR ART-

-PRIOR ART-

-PRIOR ART-

-PRIOR ART-

-PRIOR ART-

-PRIOR ART-

COMBUSTION BOILER

BACKGROUND OF THE DEVICE

1. Field of the Device

The present device relates to a combustion boiler, and relates more particularly to a combustion boiler that can have improved air suction and exhaust functions.

2. Description of the Related Art

As well known, boilers are divided into various kinds in accordance with heat source kinds, installation manners, places to be installed, suction and exhaust manners, feed water methods, structures of a heat exchanger and so on.

FIG. 1 shows an exemplary view of a conventionally used upward combustion boiler with an exhaust fan part. As shown, the conventional upward combustion boiler uses a heating pin 93*a*, wherein air is sucked from the outside, while an exhaust gas is being forcedly exhausted to the outside by virtue of an exhaust fan part 20.

In operation, if a driving motor 21 of the exhaust fan part 20 operates, an exhaust fan 23, which is fixed on the rotary shaft of the driving motor 21 is rotated, with a result that the air within a combustion chamber A forcedly flows to an exhaust line 60. Therefore, the internal pressure of the exhaust line 60 is higher than an atmospheric pressure, whereas a back pressure thereto is applied to the combustion chamber A, a burner 30, a suction line 13 and a suction inducing member 11, such that the air from the outside is sucked to the suction inducing member 11 through inlet holes 11*a* and then flows to the combustion chamber A via the suction line 13 and the burner 30. After that, the air forcedly flows to the exhaust line 60 through the exhaust fan 23 and is finally exhausted to the outside via outlet holes 60*a* of the exhaust line 60.

Under the above state, when fuel is injected from a fuel supply line 70 via a nozzle 80*a* of a fuel injection part 80, the fuel injected is mixed with the air in the interior of the burner 30. Then, the resulting mixed gas is emitted to the combustion chamber A via flame holes of the burner 30.

At this time, if an igniter (which is not shown in the drawing) operates, the mixed gas emitted through the flame holes of the burner 30 is ignited.

On the other hand, when heating water in a heating line is forcedly circulated by means of a circulating pump 100, the heating water at a low temperature flows from the lower portion of a heater (which is not shown in the drawing) to a heat exchanger 93 through a water inlet tube 91 and is then returned to the lower portion of the heater through a water outlet tube 92. As a consequence, the heating water at the low temperature in the heat exchanger 93 with the heating pin 93*a* is heated to a high temperature by the combustion gas at a high temperature in the combustion chamber A, and the heating water at the low temperature from the water inlet tube 91 flows in the interior of the heat exchanger 93 and heated to a high temperature. Then, the heated water is returned to the lower portion of the heater through the water outlet tube 92.

FIG. 2 shows another exemplary view of a conventionally used upward combustion boiler with an exhaust fan part. As shown, the conventional upward combustion boiler uses a combustion gas inducing tube 45, wherein air in the room is sucked, while an exhaust gas is being forcedly exhausted to the outside by virtue of the exhaust fan part 20.

In operation, if the driving motor 21 of the exhaust fan part 20 operates, the exhaust fan 23, which is fixed on the rotary shaft of the driving motor 21 is rotated, with a result that the air within an exhaust chamber 50 forcedly flows to the exhaust line 60 (See FIG. 3) through an exhaust hole 20*a* of the exhaust fan part 20. Therefore, the internal pressure of the exhaust line 60 is higher than an atmospheric pressure, whereas a back pressure thereto is applied to the exhaust chamber 50, the combustion gas inducing tube 45, a combustion chamber 48, a suction chamber 14 and a suction line 13, such that the air in the room is sucked to the opening of the suction line 13 and then flows to the suction chamber 14 via the suction line 13. After that, the part of the air induced to the suction chamber 14 directly flows to the combustion chamber 48 through the hole of the suction chamber 14 and the other flows to the interior of the burner 30 through a Venturi tube 31 and then to the combustion chamber 48 through the flame holes of the burner 30. Thereafter, the air flown to the combustion chamber 48 is delivered to the exhaust chamber 50 through the combustion gas inducing tube 45 and then forcedly flows to the exhaust line 60 through the exhaust fan 23 rotating, thereby being finally exhausted to the outside.

Under the above state, when fuel is injected from the fuel supply line 70 via the nozzle 80*a* of the fuel injection part 80 to a Venturi tube 31 of the burner 30, the fuel injected is mixed with the air in the interior of the suction chamber 14. Then, the resulting mixed gas is emitted to the combustion chamber 48 via the flame holes of the burner 30.

At this time, if an igniter (which is not shown in the drawing) operates, the mixed gas emitted through the flame holes of the burner 30 is ignited.

On the other hand, when heating water in a heating line is forcedly circulated by the circulating pump 100 (See FIG. 1), the heating water at a low temperature flows from the lower portion of a heater (which is not shown in the drawing) to a water chamber 46 of a heat exchanger 40 through the water inlet tube 91 (See FIG. 1) and is then returned to the lower portion of the heater through the water outlet tube 92 (See FIG. 1). As a consequence, the heating water at the low temperature in the water chamber 46 of the heat exchanger 40 is heated to a high temperature by the combustion gas being at a high temperature that flows in the combustion chamber 48 and the combustion gas inducing tube 45 and then returned to the lower portion of the heater through the water outlet tube 92.

FIG. 3 shows still another exemplary view of a conventionally used upward combustion boiler with an exhaust fan part. As shown, the conventional upward combustion boiler uses a combustion gas inducing tube 45, wherein air is sucked from the outside, while an exhaust gas is being forcedly exhausted to the outside by virtue of the exhaust fan part 20.

In this case, a suction inducing member 11 is disposed on the free end portion of the exhaust line 60, outlet holes 60*a* and inlet holes 11*a* are respectively provided on the free end of the exhaust line 60 and on the front end of the outside of the suction inducing member 11, and the suction line 13 communicates with the suction inducing member 11, such that the exhaust gas is exhausted to the outside, while the air in the outside is being sucked.

FIG. 4 shows an exemplary view of a conventionally used downward combustion boiler with an exhaust fan part. As shown, the conventional upward combustion boiler uses a combustion gas inducing tube 45, wherein air in the room is sucked, while an exhaust gas is being forcedly exhausted to the outside by virtue of the exhaust fan part 20.

In operation, if the driving motor 21 of the exhaust fan part 20 operates, the exhaust fan 23, which is fixed on the rotary shaft of the driving motor 21 is rotated, with a result that the air within an exhaust chamber 50 forcedly flows to the exhaust line 60 (See FIG. 3) through an exhaust hole 20*a* of the exhaust fan part 20. Therefore, the internal pressure of the exhaust line 60 is higher than an atmospheric pressure, whereas a back pressure thereto is applied to the exhaust chamber 50, the combustion gas inducing tube 45, an inversion inducing chamber 47, a combustion tube 44 and a suction line 13, such that the air in the room is sucked to the opening of the suction line 13. After that, the part of the air from the suction line 13 directly flows to the combustion tube 44 and the other flows to the interior of the burner 30 through the Venturi tube 31 and then to the combustion tube 44 through the flame holes of the burner 30. Thereafter, the air flowing downward along the combustion tube 44 is inverted into that upward through the inversion inducing chamber 47 and then delivered to the exhaust chamber 50 through the combustion gas inducing tube 45. After that, the air flown to the exhaust chamber 50 forcedly flows to the exhaust line 60 through the exhaust fan 23 rotating, thereby being finally exhausted to the outside.

Under the above state, when fuel is injected via the nozzle 80*a* of the fuel injection part 80 to the Venturi tube 31 of the burner 30, the fuel injected is mixed with the air in the interior of the suction chamber 14. Then, the resulting mixed gas is emitted to the combustion chamber 48 via the flame holes of the burner 30.

At this time, if an igniter (which is not shown in the drawing) operates, the mixed gas emitted through the flame holes of the burner 30 is ignited.

On the other hand, the heating water at the low temperature in the water chamber 46 of the heat exchanger 40 is heated to a high temperature by the combustion gas being at a high temperature that flows in the combustion tube 44, the inversion inducing chamber 47 and the combustion gas inducing tube 45 and then returned to the lower portion of the heater through the water outlet tube 92 (See FIG. 1).

However, in the conventionally used combustion boiler with the exhaust fan part 20, as shown in FIGS. 1 to 4, the exhaust gas is forcedly exhausted to the outside by means of the exhaust fan part 20, while the air in the room or from the outside is being sucked by means of the back pressure thereto.

Therefore, the suction of air is not smoothly carried out when compared with the exhaust of the exhaust gas (that is, an amount of air sucked is smaller than that expected due to the friction caused upon flowing of air), such that the mixed gas is incompletely burnt, thereby resulting in the reduction of thermal efficiency and a noxious gas is exhausted, thereby resulting in the air contamination.

In order to solve the above problems, there is provided a combustion boiler with a forced feed part 1, as shown in FIGS. 5 to 7, in which the air in the room or from the outside is forcedly sucked by means of the forced feed part 1, while the exhaust gas is being exhausted to the outside by means of a negative pressure thereto.

The forced feed part 1 is composed of a suction fan 1*b* for forcedly blowing the air in the outside into a combustion chamber 48 or a combustion tube 44, a driving motor 1*a* for rotating the suction fan 1*b*, an injection nozzle 1*d* for injecting fuel supplied from a fuel supply line 70 and an igniter (which is omitted in the drawing) for igniting a mixed gas.

In the conventional combustion boiler, the air in the room or in the outside is forcedly sucked by means of the forced feed part 1, such that the fuel and gas are appropriately mixed and the combustion of the mixed gas is well carried out, thereby increasing the rate of combustion.

However, the exhaust gas is not well exhausted due to the friction caused upon flowing of air, with a result that much load is applied to the driving motor 1*a* of the forced feed part 1.

As a consequence, a large-sized forced feed part 1 should be required, and upon driving, it generates serious noises, which requires an additional silencer.

SUMMARY OF THE DEVICE

It is an object of the present device to provide a combustion boiler that can have improved air suction and exhaust functions.

To accomplish this and other objects of the present device, there is provided a combustion boiler having a suction line and an exhaust line, for forcedly executing suction and/or exhaust via a fan part, which includes: the fan part comprising a driving motor, a suction fan secured on a rotary shaft of the driving motor and disposed on the suction line, for forcedly sucking air in the room or from the outside, and an exhaust fan secured on the rotary shaft of the driving motor and disposed on the exhaust line, for forcedly exhausting an exhaust gas to the outside.

BRIEF DESCRIPTION OF THE DRAWINGS

Other objects, advantages and details of the combustion boiler appear in the following detailed description of preferred embodiments of the device, the detailed description referring to the drawings in which.

DETAILED DESCRIPTION OF THE PREFERRED EMBODIMENT

The preferred embodiment of the present device will be in detail discussed with reference to the accompanying drawings.

Figure 10:
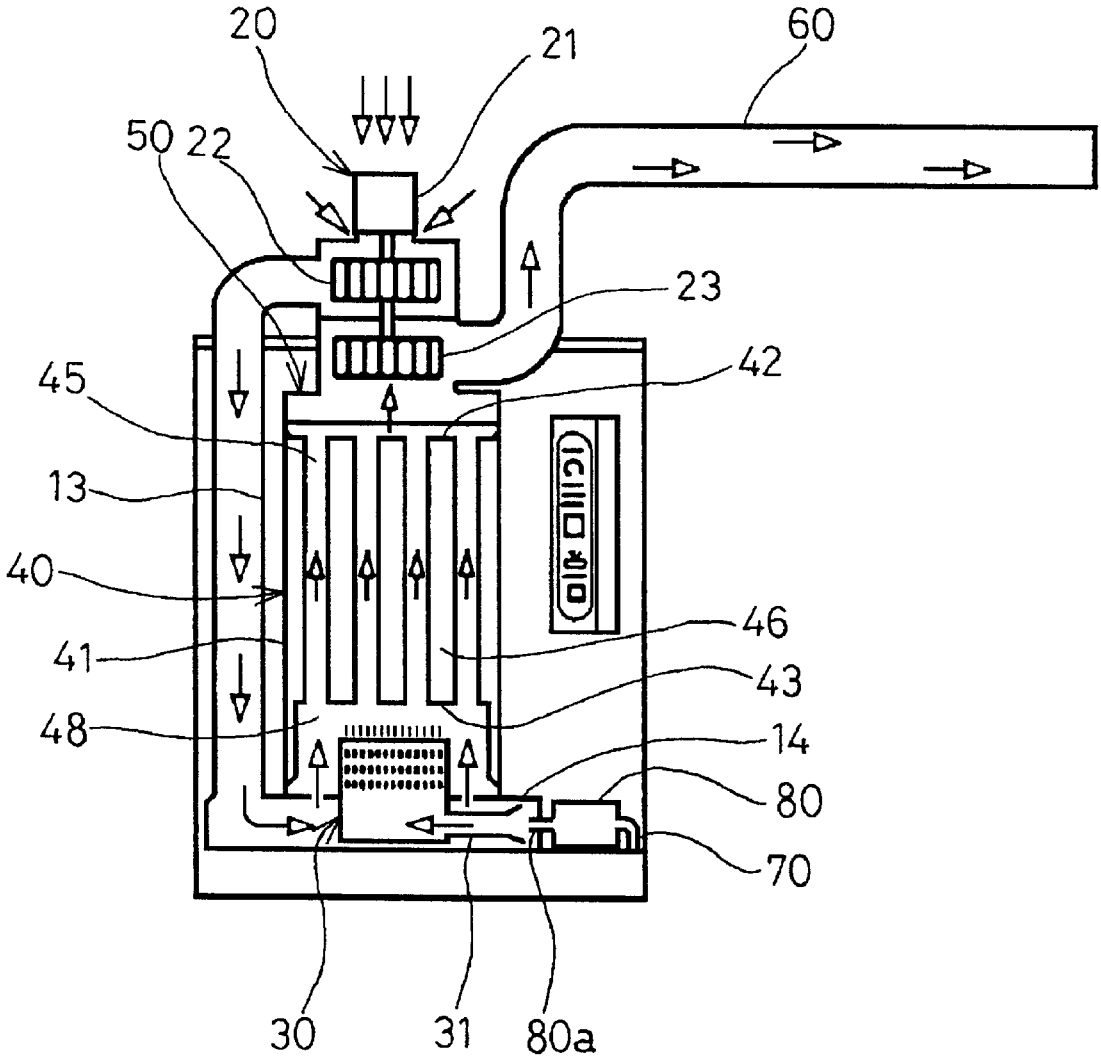
Figure 11:
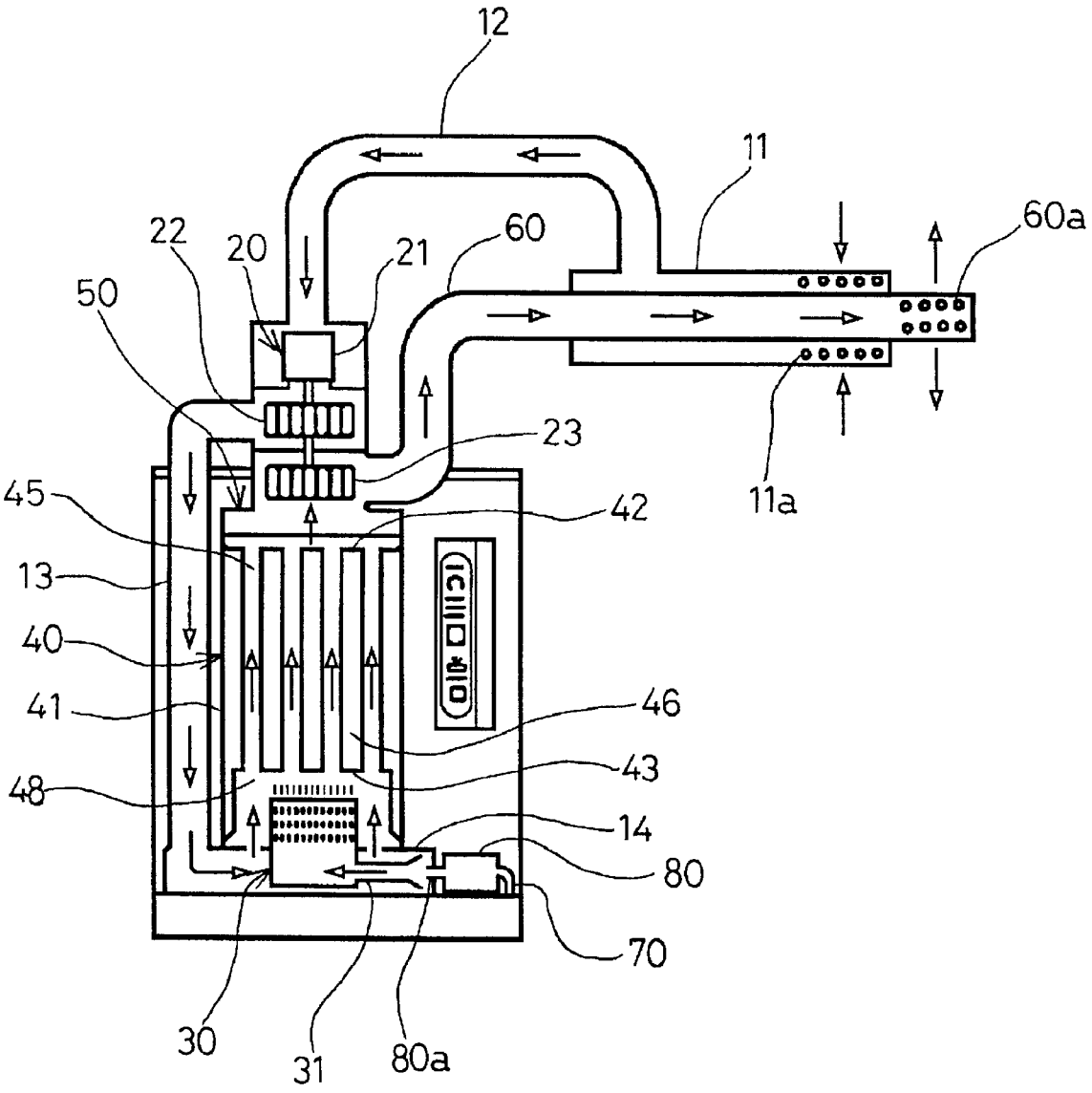
Figure 12:
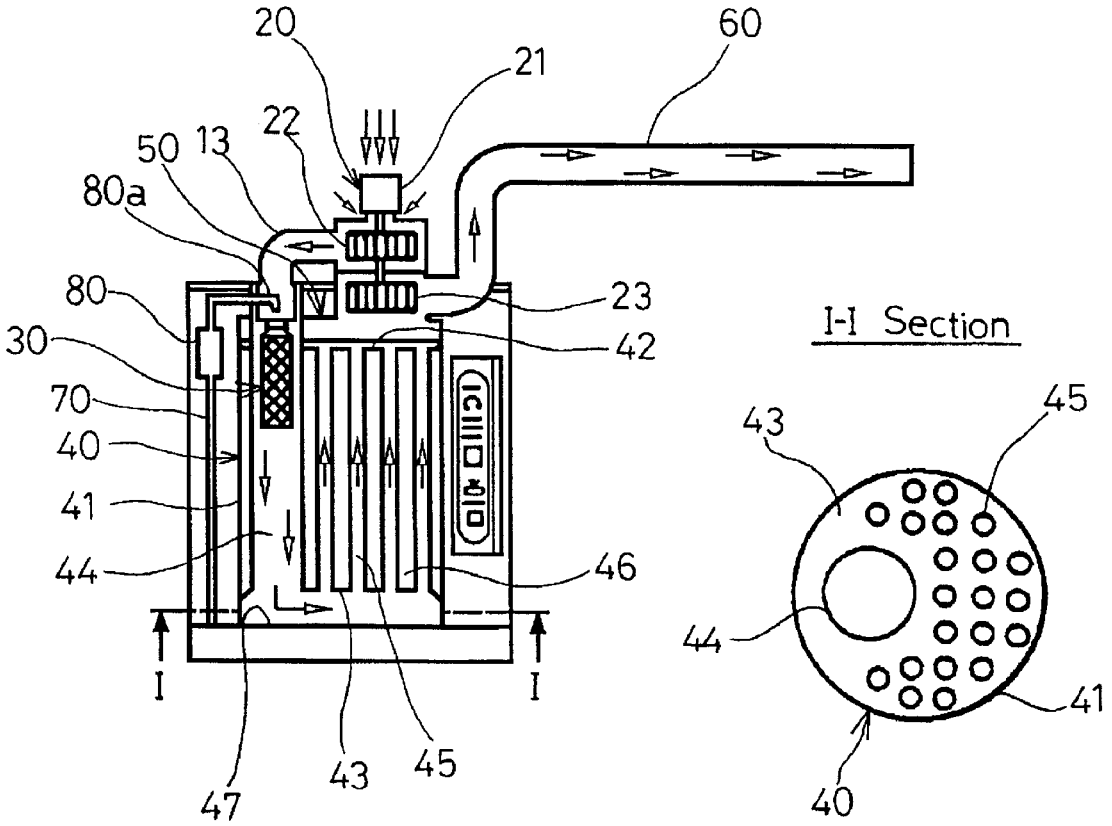
FIGS. 12 and 13 show exemplary views of downward combustion boilers with a fan part for suction and exhaust constructed in accordance with the principles of the present device.
Figure 13:
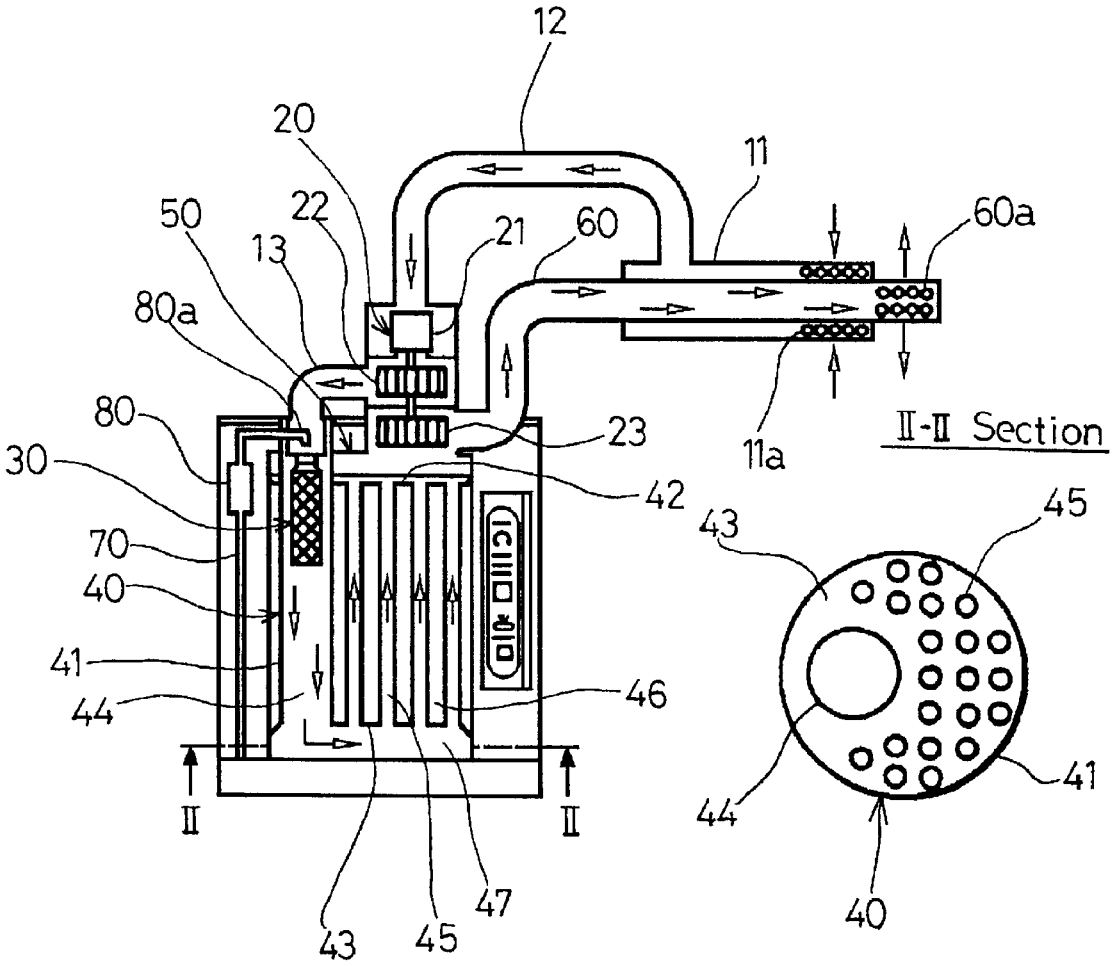

FIGS. 8 to 11 show exemplary views of upward combustion boilers with a fan part for suction and exhaust constructed in accordance with the principles of the present device, and FIGS. 12 and 13 show exemplary views of downward combustion boilers with a fan part for suction and exhaust constructed in accordance with the principles of the present device, wherein the parts corresponding to those of FIGS. 1 to 7 are indicated by corresponding reference numerals and an explanation of them will be omitted.

Figure 1:
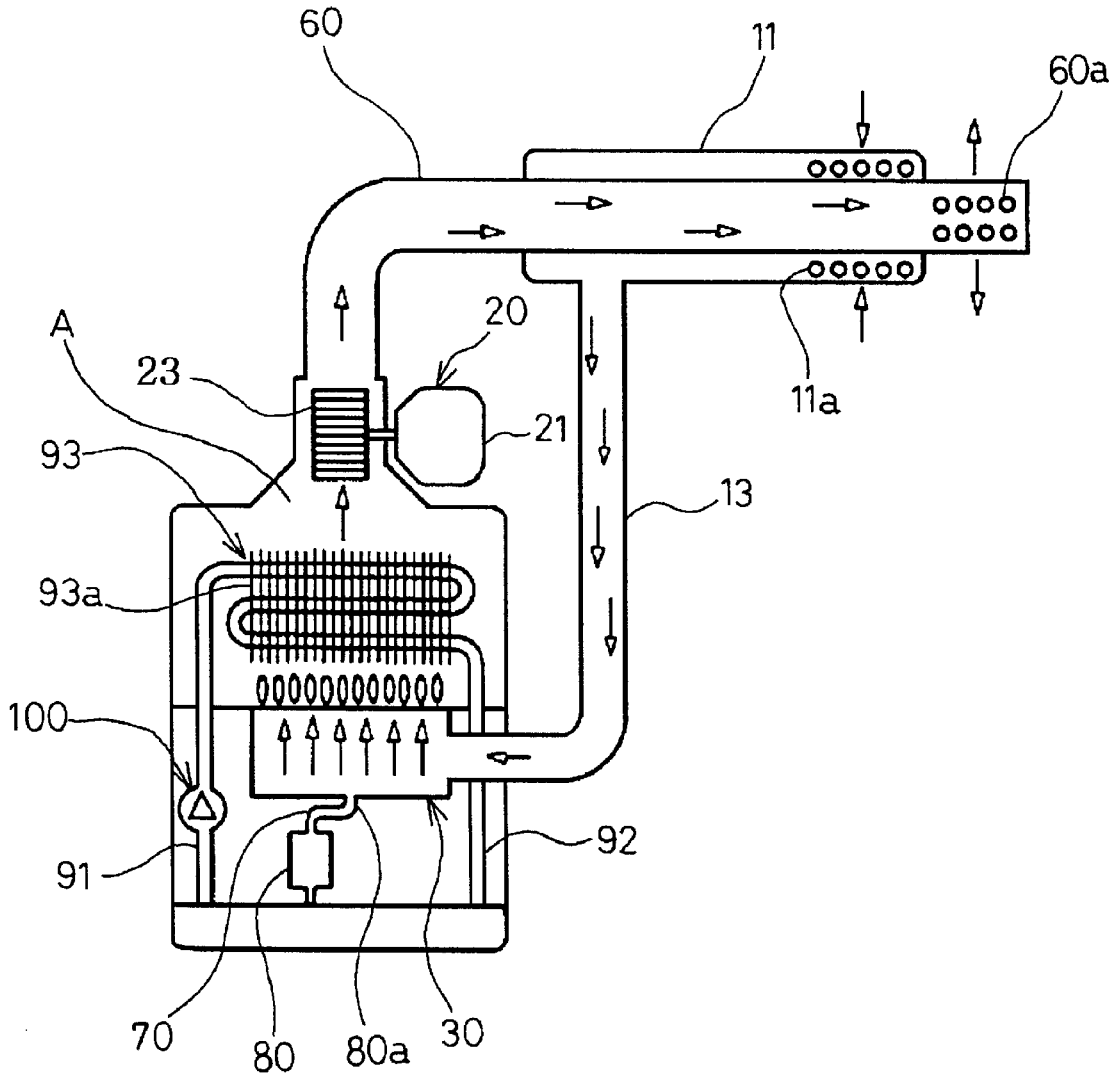
FIGS. 1 to 3 show exemplary views of conventional upward combustion boilers with an exhaust fan part.
Figure 2:
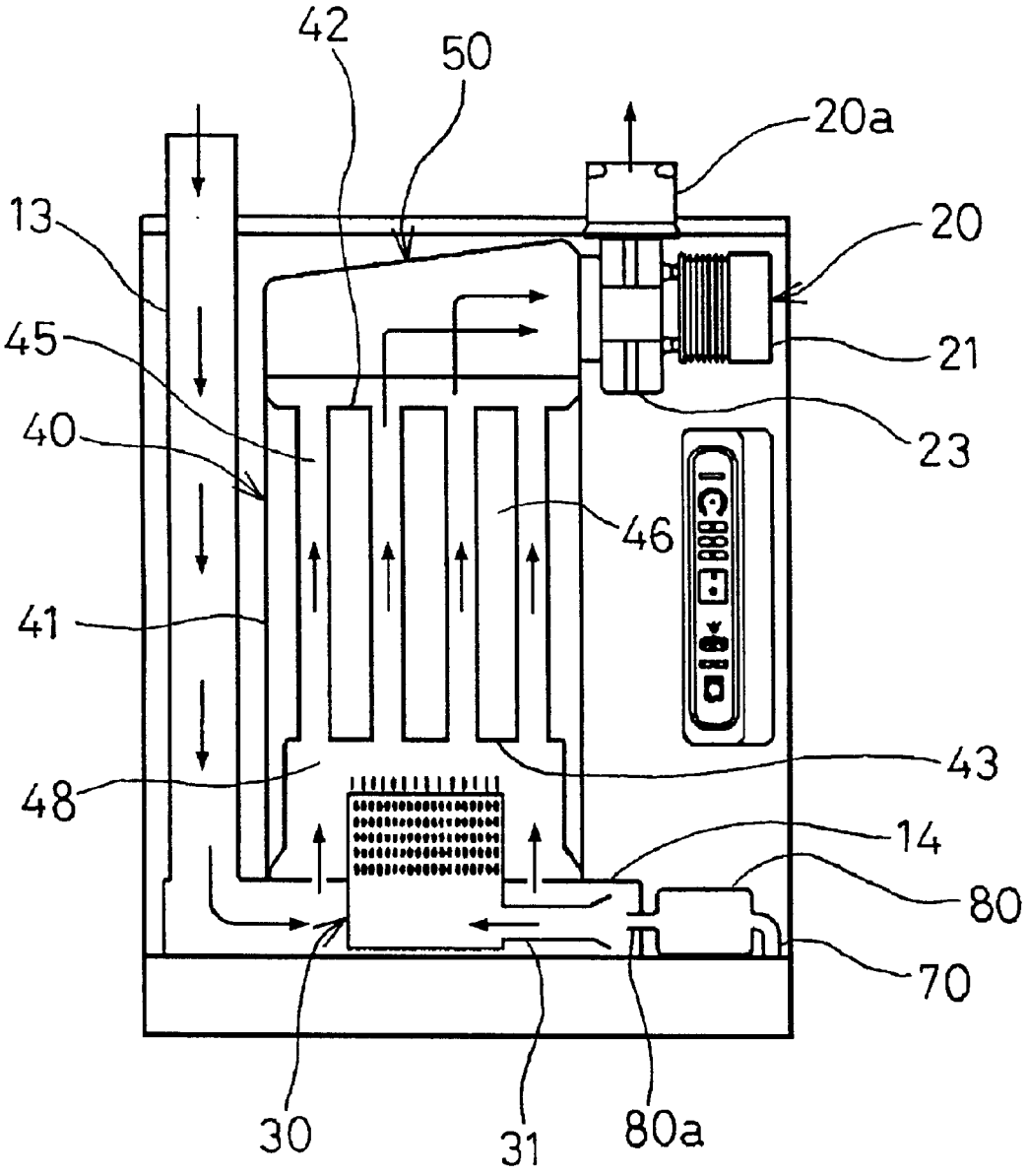
Figure 3:
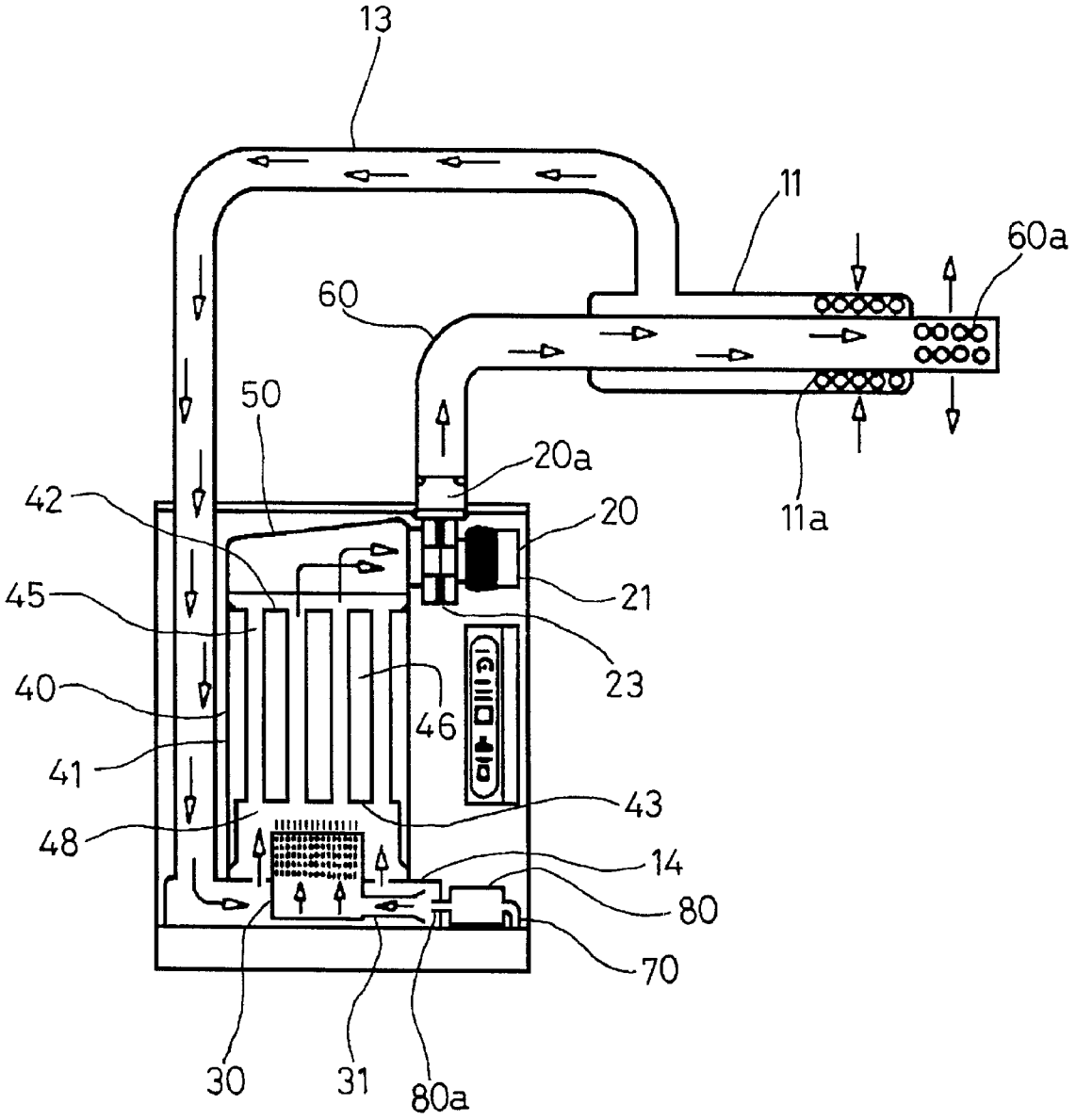
Figure 4:
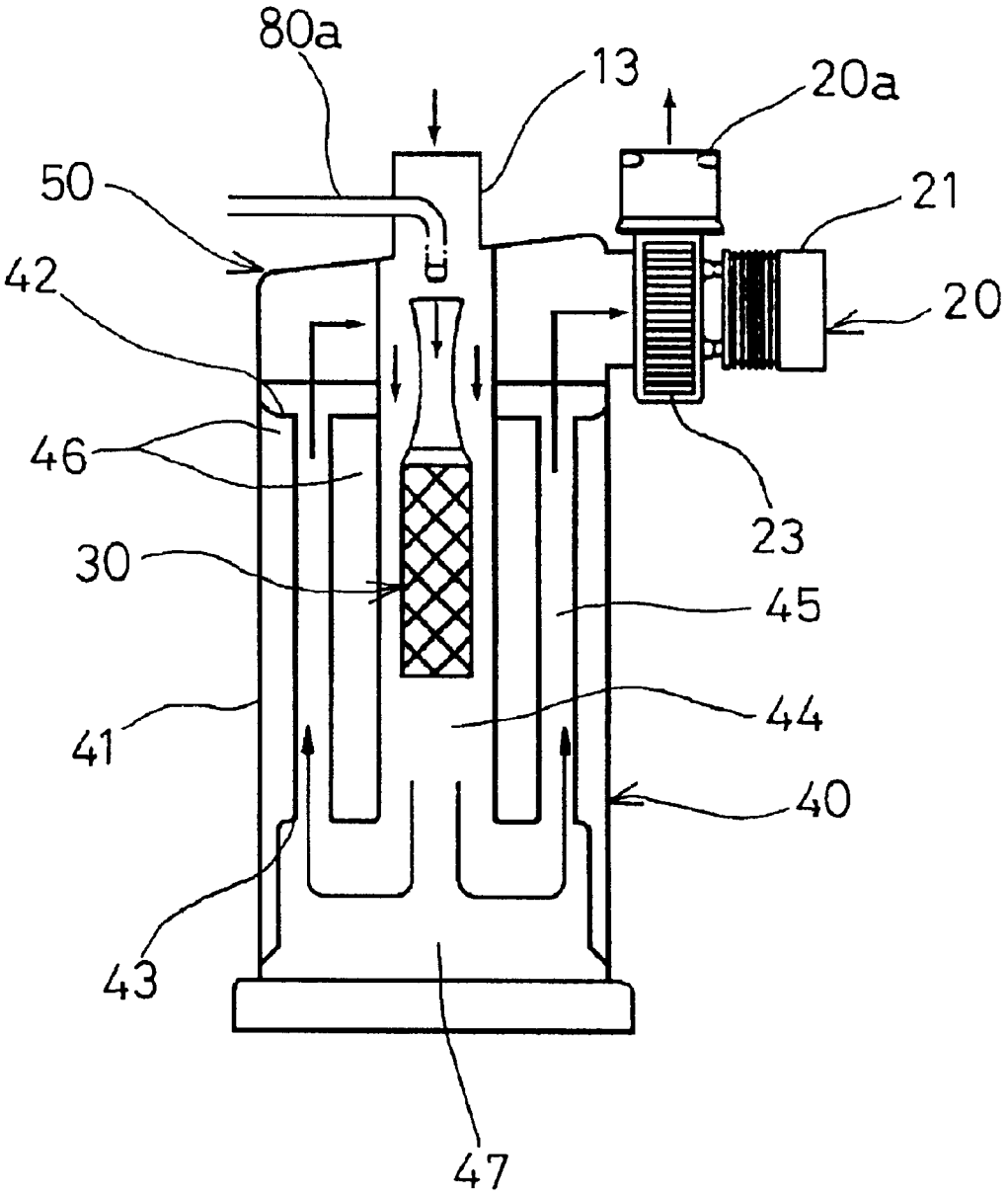
FIG. 4 shows an exemplary view of a conventional downward combustion boiler with an exhaust fan part.
Figure 5:
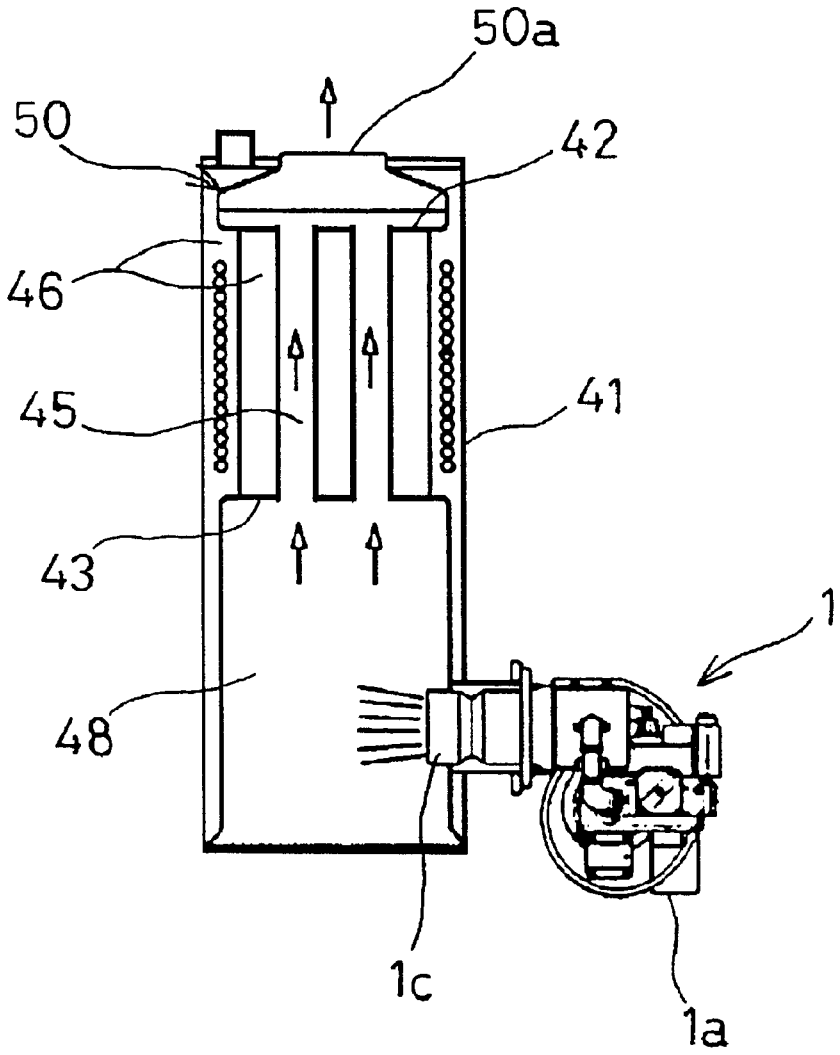
FIG. 5 shows an exemplary view of a conventional upward combustion boiler with a forced feed part.
Figure 6:
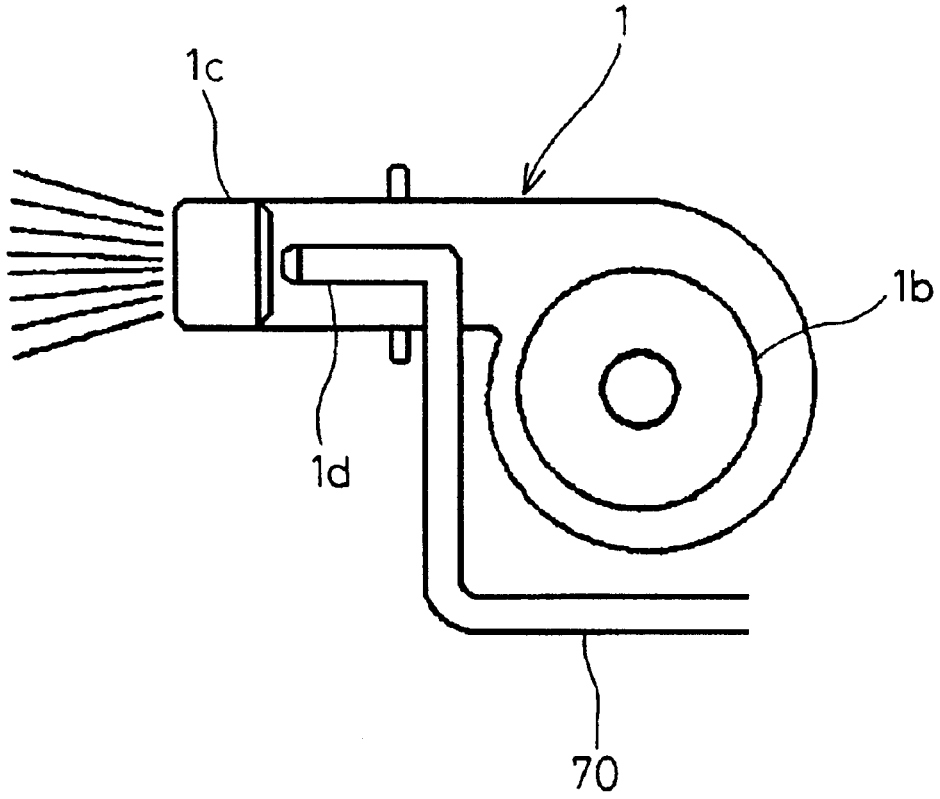
FIG. 6 shows the principal parts of the forced feed part in FIG. 5.
Figure 7:
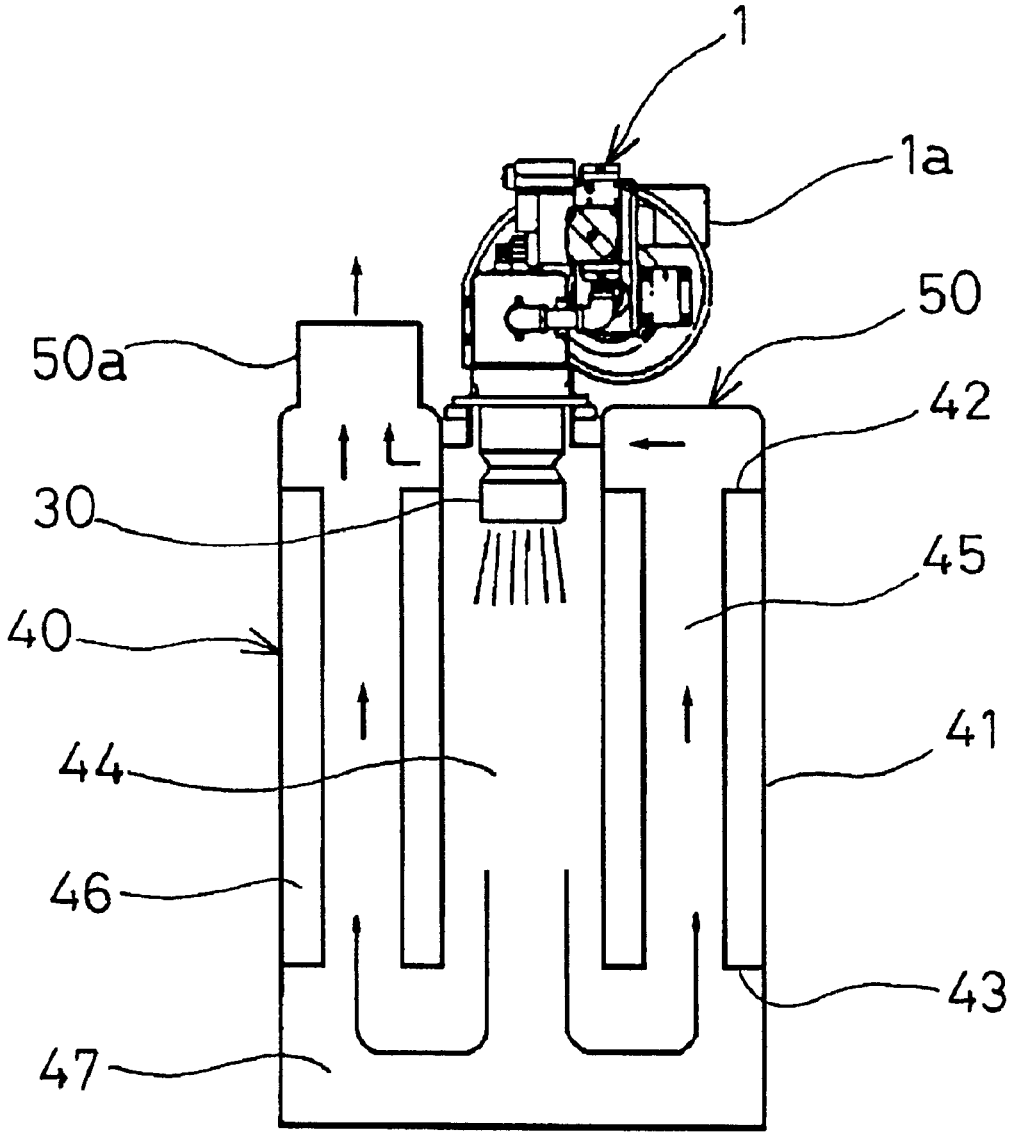
FIG. 7 shows an exemplary view of a conventional downward combustion boiler with a forced feed part.
Figure 8:
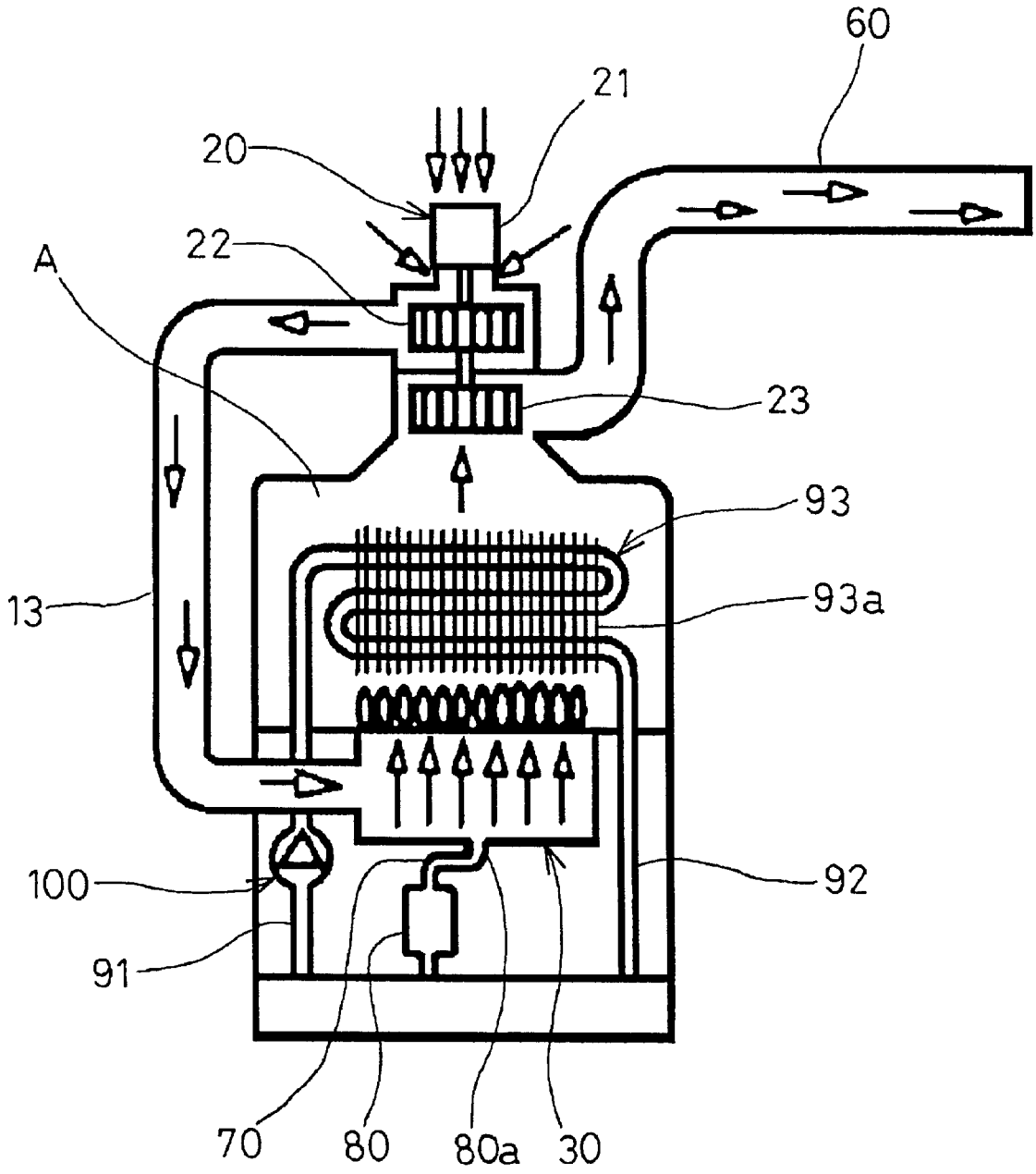
FIGS. 8 to 11 show exemplary views of upward combustion boilers with a fan part for suction and exhaust constructed in accordance with the principles of the present device.

FIG. 8 shows an exemplary view of an upward combustion boiler with a fan part for suction and exhaust 20 constructed in accordance with the principles of the present device. According to the present device, the upward combustion boiler uses a heating pin 93*a*, wherein the air in the room is forcedly sucked, while an exhaust gas is being forcedly exhausted to the outside, by virtue of the fan part for suction and exhaust 20.

Figure 9:
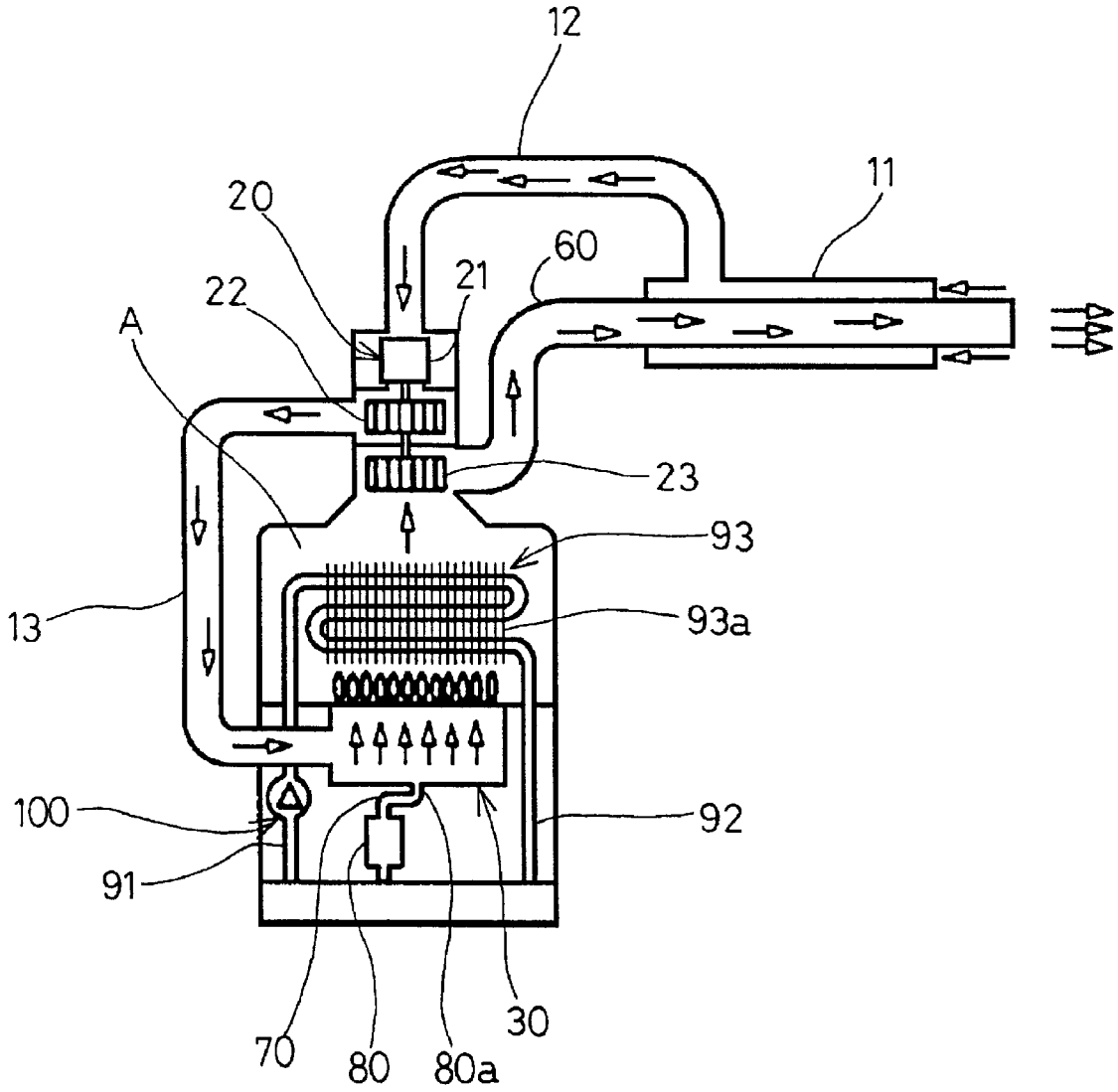

FIG. 9 is a variation of FIG. 8, which shows another exemplary view of an upward combustion boiler with the fan part for suction and exhaust 20 constructed in accordance with the principles of the present device. According to the present device, the upward combustion boiler uses the heating pin 93*a*, wherein air is forcedly sucked from the outside, while an exhaust gas is being forcedly exhausted to the outside, by virtue of the fan part for suction and exhaust 20.

FIG. 10 shows still another exemplary view of an upward combustion boiler with the fan part for suction and exhaust 20 constructed in accordance with the principles of the present device. According to the present device, the upward combustion boiler uses a combustion gas inducing tube 45, wherein the air in the room is forcedly sucked, while an exhaust gas is being forcedly exhausted to the outside, by virtue of the fan part for suction and exhaust 20.

FIG. 11 is a variation of FIG. 10, which shows still another exemplary view of an upward combustion boiler with the fan part for suction and exhaust 20 constructed in accordance with the principles of the present device. According to the present device, the upward combustion boiler uses the combustion gas inducing tube 45, wherein air is forcedly sucked from the outside, while an exhaust gas is being forcedly exhausted to the outside, by virtue of the fan part for suction and exhaust 20.

FIG. 12 shows an exemplary view of a downward combustion boiler with the fan part for suction and exhaust 20 constructed in accordance with the principles of the present device. According to the present device, the downward combustion boiler uses the combustion gas inducing tube 45, wherein the air in the room is forcedly sucked, while an exhaust gas is being forcedly exhausted to the outside, by virtue of the fan part for suction and exhaust 20.

A heat exchanger 40 used in the preferred embodiments of the present device includes: a cylindrical outer tank 41 having upper and lower openings closed by means of upper and lower caps 42 and 43; a combustion tube 44 and a plurality of combustion gas inducing tubes 45 disposed in the interior of the outer tank 41, the combustion tube 44 disposed eccentrically from the center of the outer tank 41; a water chamber 46 formed between the outer tank 41, the upper and lower caps 42 and 43, the combustion tube 44 and the plurality of combustion gas inducing tubes 45 in manner to be closed as the opened ends of the both sides of the combustion tube 44 and the plurality of combustion gas inducing tubes 45 pass through the upper and lower caps 42 and 43; and an inversion inducing chamber 47 formed on the lower portion of the lower cap 43.

According to the present device, when the heat exchanger 40 where the combustion tube 44 and the combustion gas inducing tubes 45 are eccentrically disposed is used, the exhaust gases from the plurality of combustion gas inducing tubes 45 are uniformly exhausted, thereby improving the heat exchanging function thereof.

FIG. 13 is a variation of FIG. 12, which shows another exemplary view of the downward combustion boiler with the fan part for suction and exhaust 20 constructed in accordance with the principles of the present device. According to the present device, the downward combustion boiler uses the combustion gas inducing tube 45, wherein air is forcedly sucked from the outside, while an exhaust gas is being forcedly exhausted to the outside, by virtue of the fan part for suction and exhaust 20.

The fan part for suction and exhaust 20 according to the present device is comprised of a driving motor 21, a suction fan 22 secured on a rotary shaft of the driving motor 21 and disposed on a suction line 12 or 13, for forcedly sucking air in the room or from the outside, and an exhaust fan 23 secured on the rotary shaft of the driving motor 21 and disposed on an exhaust line 60, for forcedly exhausting an exhaust gas to the outside.

If the driving motor 21 is driven, the suction fan 22 and the exhaust fan 23 respectively fixed on the rotary shaft of the driving motor 21 are simultaneously rotated, with a result that the air in the room or from the outside is forcedly sucked to the suction line 12 or 13 by means of the suction fan 22 and the exhaust gas is forcedly exhausted to the exhaust line 60 by means of the exhaust fan 23.

In this way, the flowing of air is constantly kept in all of the suction, combustion and exhaust lines, and a maximum amount of load of the driving motor 21 is reduced.

As clearly appreciated from the foregoing, a combustion boiler according to the present device has a fan part for suction and exhaust where air is forcedly sucked and an exhaust gas is forcedly exhausted, such that the flowing of air is constantly kept in all of the suction, combustion and exhaust lines, thereby improving the inherent functions of the boiler.

In addition, a maximum amount of load of a driving motor is greatly reduced, such that the noises generated from the fan part can be suppressed and a small-size fan part can be embodied, thereby reducing the production cost.

What is claimed is:

1. A combustion boiler having a heat exchanger, a suction line and an exhaust line and for forcedly executing suction and/or exhaust via a fan part, said combustion boiler comprising:

said fan part comprising, a driving motor, a suction fan secured on a rotary shaft of said driving motor and disposed on said suction line, for forcedly sucking air in the room or from the outside, and an exhaust fan secured on the rotary shaft of said driving motor and disposed on said exhaust line, for forcedly exhausting an exhaust gas to the outside.

2. The combustion boiler according to claim 1, wherein a heat exchanger comprises: a cylindrical outer tank having upper and lower openings closed by means of upper and lower caps; a combustion tube and a plurality of combustion gas inducing tubes disposed in the interior of the outer tank, said combustion tube disposed eccentrically from the center of the outer tank; a water chamber formed between the outer tank, said upper and lower caps, said combustion tube and said plurality of combustion gas inducing tubes in manner to be closed as the opened ends of the both sides of said combustion tube and said plurality of combustion gas inducing tubes pass through said upper and lower caps; and an inversion inducing chamber formed on the lower portion of said lower cap.

* * * * *